United States Patent [19]

Bean, Jr.

[11] Patent Number: 4,738,478

[45] Date of Patent: Apr. 19, 1988

[54] BAG ATTACHING DEVICE

[76] Inventor: Paul W. Bean, Jr., P.O. Box 3210, Oak Mountain Trail, San Angelo, Tex. 76904

[21] Appl. No.: 904,620

[22] Filed: Nov. 13, 1986

[51] Int. Cl.[4] ..... A47F 13/08; B65B 67/12

[52] U.S. Cl. ..... 294/55; 294/1.1; 248/99; 248/101

[58] Field of Search ..... 294/55, 19.1, 1.1, 113; 15/104.8, 257.1; 141/108, 109, 390, 391; 248/99, 101

[56] References Cited

U.S. PATENT DOCUMENTS 3,942,832 3/1976 Haas, Jr. ..... 294/55

4,470,627 9/1984 Carroll et al. ..... 294/55

*Primary Examiner*—James B. Marbert

*Attorney, Agent, or Firm*—G. Turner Moller

[57] ABSTRACT

A bag holder comprises a closed loop of generally U-shaped cross-section having an outwardly facing open sided channel. A flexible bag has its open neck extending upwardly through a central opening of the loop and is folded over the loop to cover the open sided channel. An elastic loop is received in the open sided channel to captivate the entire periphery of the sack in the channel. A handle extends from below the free edge of the sack to a radially spaced location where it can be grasped by the user.

12 Claims, 2 Drawing Sheets

BAG ATTACHING DEVICE

This invention relates to a ring-like device to which a refuse bag is attached for holding the top of the bag open.

Anyone who has picked up trash and put it in a plastic garbage sack has experienced the aggravation caused by the open top of the bag collapsing and failing to stay open to receive trash therethrough. Half of one's effort is spent in keeping the top of the sack open. It is accordingly not surprising that there are proposals in the prior art to provide a device which will spread open the top of a garbage sack and keep it open. Disclosurs of this general type are found in U.S. Pat. Nos. 3,614,041; 3,942,832 and 3,998,415.

As will be more fully apparent hereinafter, the most relevant of these disclosures of this invention is found in U.S. Pat. No. 3,942,832 because both devices comprise a generally ring like device adapted to receive the open top of the sack therethrough, a handle and an elastic strap or band for securing the open top of the sack to the ring like device. An analysis of this device of the prior art reveals a substantial defect, i.e. the elastic bag retaining strap does not make a complete 360° wrap around the sack. In other words, the elastic strap and the ring do not captivate the sack therebetween throughout the periphery of the sack. This defect in the prior art device is caused by the position of the handle or how the handle connects to the ring. It will be noted that the handle construction is such that there is a gap between the sack and the elastic strap in the vicinity of the handle.

The effect of this defect is best seen by a comparison of the lifting ability of two bag holders, identical in all respects except that the bag is separated from the elastic strap for a distance of about 2" in the second device. The bag holder used in this test was a prototype of this invention. The bag used was a 1½ mil 30 gallon bag sold under the name BRUTE. The lifting ability of a garbage sack—bag holder assembly of this type is deemed to be exceeded when the bag begins to move relative to the elastic strap. This event signals impending release of the bag and is easily noted because the bag begins to roll or twist the elastic strap. In the following tests, the bag was filled with increasing amounts of the specified material until the bag began to roll the elastic strap.

TABLE I

| |
|---|
| Test #1 - Device #1 - bag rolls when water load reaches 20# |
| Test #2 - Device #1 - bag rolls when trash load reaches 29# |
| Test #3 - Device #2 - bag rolls when trash load reaches 8# |

It will thus be seen that providing a bag holding device in which the elastic strap completely surrounds the sack periphery provides a ring-bag construction having significantly increased lifting capacity.

In summary, this invention comprises a bag holding device for attachment to the open top of a garbage sack and includes a closed generally planar loop of U-shaped cross-section in which the legs of the U are generally parallel to the plane of the loop. The open top of the garbage sack extends through the open center of the loop and then is folded over the loop. An elastic strap or band is then placed to reside in the open channel provided by the U-shaped cross-section. The elastic strap extends throughout the periphery of the open top of the bag. A handle is provided and connects to the loop below the open channel provided thereby.

It is accordingly an object of this invention to provide an improved bag holder which will hold open the top of a refuse sack.

Another object of this invention is to provide an improved ring-shaped bag holding structure for holding open the top of a garbage bag which provides a handle thereon positioned to maximize the lifting capacity of the device.

These and other objects of this invention will become more fully apparent as this description proceeds, reference being made to the accompanying drawings and appended claims.

IN THE DRAWINGS

Figure 1:
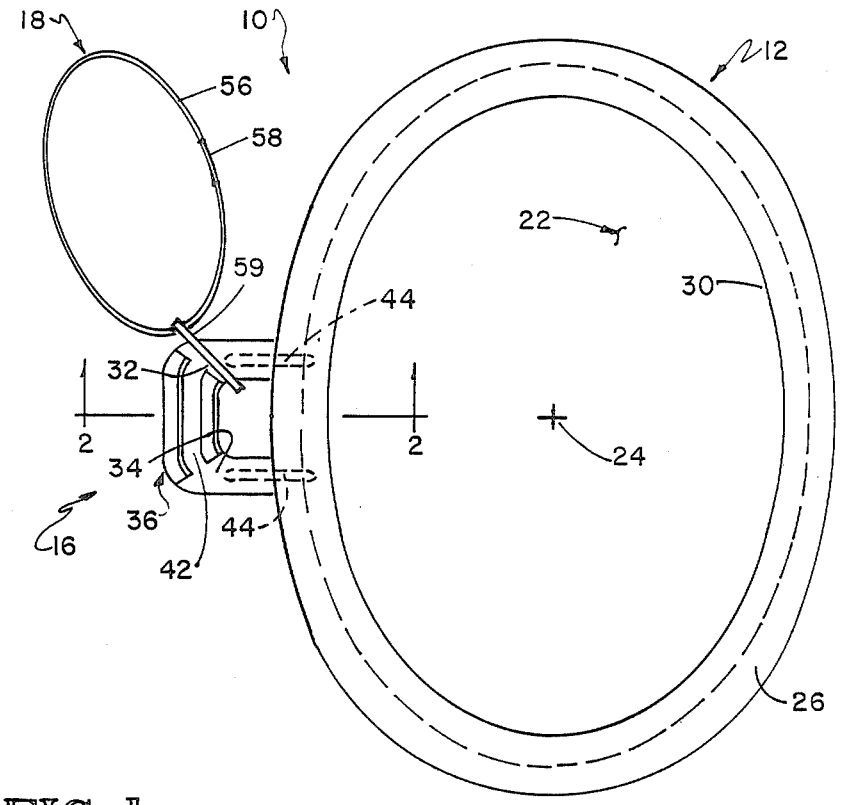
FIG. 1 is a top plan view of a bag holding device of this invention.
Figure 2:
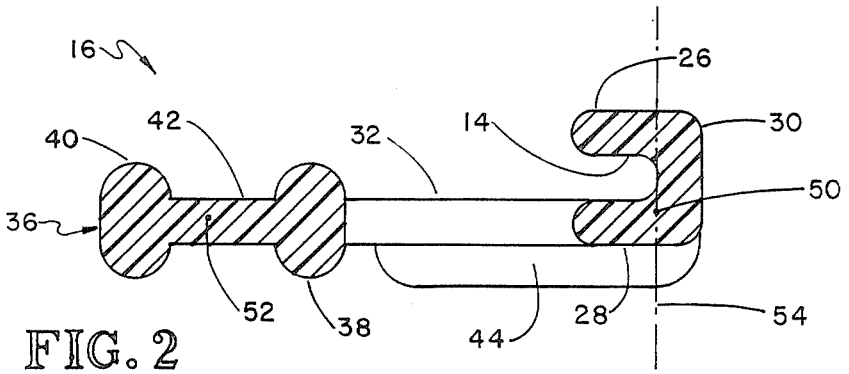
FIG. 2 is an enlarged cross-sectional view of the device of FIG. 1 taken substantially along line 2—2 thereof as viewed in the direction indicated by the arrows.

Referring to FIGS. 1 and 2, there is illustrated a bag holder 10 of this invention comprising, as major components, a rigid loop 12 having an outwardly facing open channel 14 and a handle 16, and an elastic loop 18 for captivating a sack 20 to the loop 12.

The rigid loop 12 and handle 16 are preferably injection molded as one piece from an organic polymeric material such as polyethylene, polypropylene, polyvinyl chloride or the like. The loop 12 is generally planar and provides a relatively large central opening 22 symmetrical about a central axis 24. Although the opening 22 is preferably elliptical or somewhat oblong, it will be evident that the opening 22 may be of any suitable arcuate shape such as circular or the like.

The body of the loop 12 is generally U-shaped in cross section having an upper generally planar wall 26 and a spaced generally parallel lower planar wall 28 defining the open channel 14 therebetween. A back wall 30 closes the inner end of the channel 14. Although the loop 12 may be of any suitable size, it is preferred that the central opening 22 be about 14" long in the long dimension, about 9" wide in the short dimension and have ends on about 4½" radii.

The handle 16 and its connection to the loop 12 is of particular interest. The handle 16 is illustrated as comprising a generally planar extension of the bottom wall 28 and includes a pair of legs 32, 34 of substantially the same thickness as the bottom wall 28. A transverse leg 36 of the handle 16 connects the legs 32, 34. The transverse leg 36 includes inner and outer edges 38, 40 of enlarged thickness and a central section 42 of substantially the same thickness as the legs 32, 34. It will be evident that the inner and outer edges 38, 40 provide relatively large bearing surfaces with the user's hand thereby making the bag holder 10 more comfortable to carry. One or more ribs 44 are provided on the legs 32, 34 in order to stiffen or rigidify the legs 32, 34. It will be seen that this expedient provides greater rigidity for the handle 16.

Figure 3:
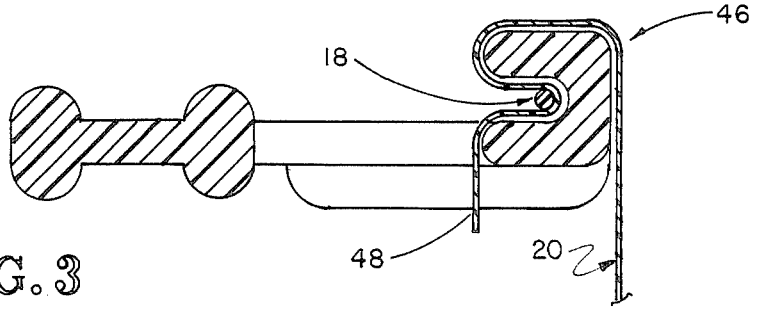
FIG. 3 is a view similar to FIG. 2 illustrating the relationship between the bag and the bag holder.

The sack or bag 20 is of conventional type made of organic polymeric material having an open end or neck 46 which extends upwardly through the loop 12. It will accordingly be seen that the neck 46 is of generally J-shape in cross-section having a short leg 48 comprising a open edge portion of the sack 16. The short leg or open edge portion 48 extends across the open channel 14 throughout the periphery of the loop 12 and is captivated by the elastic loop 18, when received in the channel 14 as shown in FIG. 3. From FIG. 3, it will be seen that the elastic loop 18 captivates the open edge portion 48 of the sack 16 throughout the periphery of the sack 16 because the handle 16 is connected to the loop 12 below the channel 14. Thus, the bag holder 10 of this invention provides increased load carrying capacity when compared to bag holders which do not captivate the entire periphery of the open neck of the bag with which it is associated.

It will be seen that the handle 36 extends away from the central axis 24 at a first location 50 axially spaced from the open sided channel 14 to a second location 52 radially spaced from the first location 50. Similarly, it will be apparent that the upper wall 26, the lower wall 28 and the first location 50 define a line 54 generally parallel to the central axis 24 such that the first location 50 lies in the lower wall 28. In the embodiment of FIGS. 1–3, the handle 36 is accordingly coplanar with the lower wall 28.

The elastic loop 18 may be of any suitable type. Conveniently, the elastic loop 18 comprises an elastic member 56 of a commercially available type known as a "bungee cord" which is widely used in connection with boats as an elastic tie down device. Typically, the bungee cords used in the boating industry have hooks on each end thereof to provide means for attachment to the article to be tied down. When used in this invention, it is preferred that the ends of the elastic member 56 be permanently joined by an appropriate crimped end fixture 58. Although the elastic loop 18 is circular in cross-section, it will be evident that other shapes, including polygonal are suitable. The elastic loop 18 is desirably secured to the handle 16 in any suitable manner, as by the use of a band 59.

Figure 4:
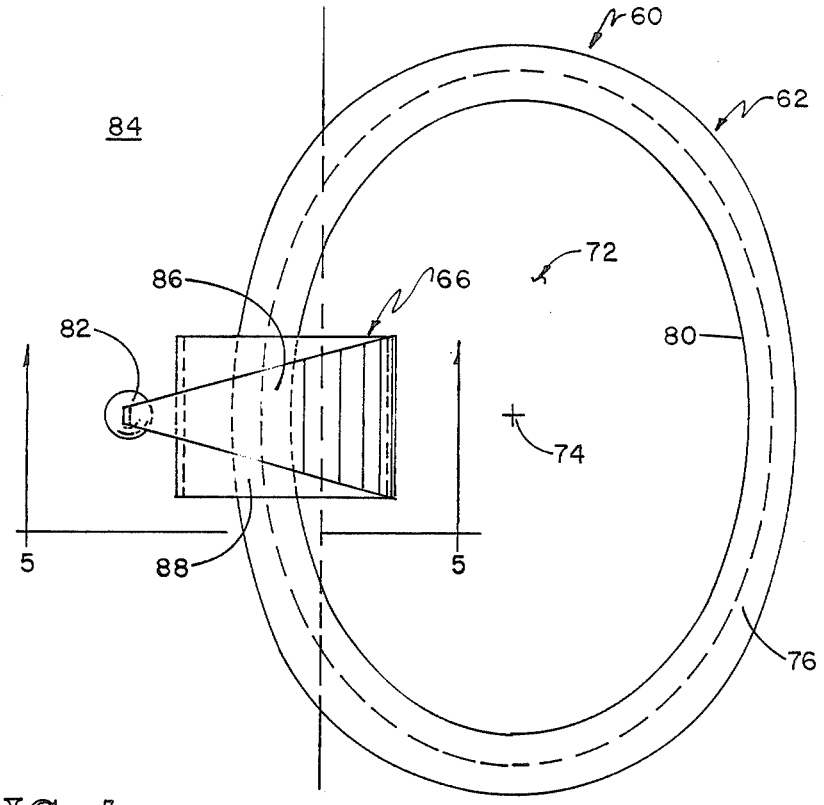
FIG. 4 is a top plan view of another embodiment of a bag holding device of this invention illustrating another handle arrangement.

Referring to FIG. 4, there is illustrated another embodiment of this invention comprising a bag holder 60 having, as major components, a rigid loop 62 providing an outwardly facing open channel 64 and a handle 66, and an elastic loop 68 for captivating a sack 70 to the loop 62.

The rigid loop 62 and handle 66 are preferably injection molded as one piece from an organic polymeric material such as polyethylene, polypropylene, polyvinyl chloride or the like. The loop 62 is generally planar and provides a relatively large central opening 72 symmetrical about a central axis 74. Although the opening 72 is preferably elliptical or somewhat oblong, it will be evident that the opening 72 may be of any suitable arcuate shape such as circular or the like.

The body of the loop 62 is generally U-shaped in cross section having an upper generally planar wall 76 and a spaced generally parallel lower planar wall 78 defining the open channel 64 therebetween. A back wall 80 closes the inner end of the channel 64. Although the loop 62 may be of any suitable size, it is preferred that the central opening 72 of the bag holder 60 be substantially the same as that of the bag holder 10.

The handle 66 and its connection to the loop 62 is of particular interest. The handle 66 is illustrated as comprising a generally S-shaped handle comprising a free end or ball support 82 which may rest on a table 84 or the like, a pair of intermediate curves 86, 88 and a lower end connection 90 which is integral with the back wall 80 and/or the bottom wall 78 as shown best in FIG. 5. It will be seen that the handle 66 extends away from the central axis 74 at a first location 92 axially spaced from the open sided channel 64 to a second location 94 radially spaced from the first location 92. Similarly, it will be apparent that the upper wall 76, the lower wall 78 and the first location 92 define a line 96 generally parallel to the central axis 74 such that the lower wall 78 lies between the upper wall 76 and the first location 92. Thus, the connection 90 extends downwardly away from the bottom wall 78. Similarly, the connection 90 could extend into supporting engagement with the back wall 80.

Figure 5:
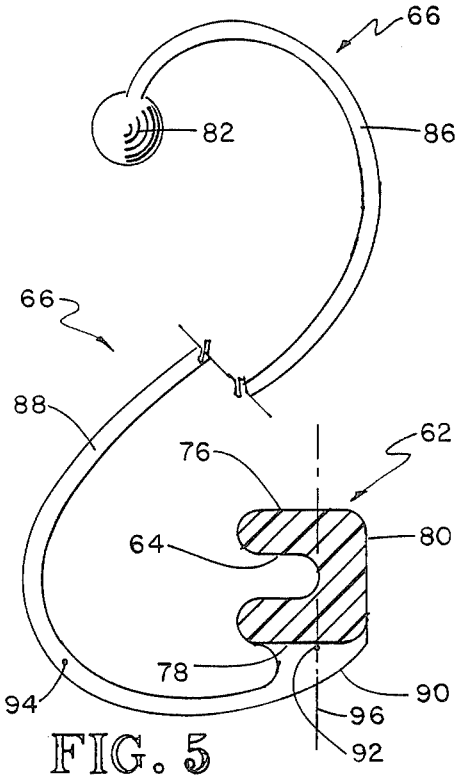
FIG. 5 is an enlarged cross-sectional view of the device of FIG. 4 taken substantially along line 5—5 thereof as viewed in the direction indicated by the arrows.
Figure 6:
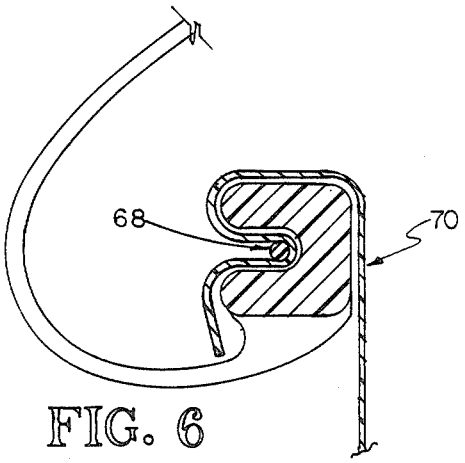
FIG. 6 is a view similar to FIG. 5 illustrating the relationship between the bag and the bag holder.

In the embodiment of FIGS. 1–3, the handle 66 extends downwardly out of the plane of the lower wall 78 at a location spaced inwardly from the outer end of the open channel 64. It will accordingly be seen that the relationship between the sack 70 and the loop 62 in the embodiment of FIGS. 4–6 is the same as that in the embodiment of FIGS. 1–3 and that the elastic loop 68 captivates the entire periphery of the open neck of the sack 70 against the loop 62.

It will be evident that the center of gravity of the combined bag holder 60 and sack 70 will be located more-or-less under the free end 82 of the handle 66 thereby supporting the bag holder 60 on the table 84. The showing of FIG. 4 is accordingly somewhat out of proportion because the axis 74 will extend through the ball support 82 in an at rest position without the sack 70 thereon. Thus, in FIG. 4, the loop 62 has been rotated upwardly to be in the plane of the paper.

Although the invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A bag holder for spreading the mouth of a sack, comprising a closed loop having a large central opening providing a central axis generally perpendicular to the loop;

a sack having an open end, received in the central opening, of inverted J-shaped section passing over and reverted about the loop, the inverted J-shaped section having a short leg comprising an open edge portion of the sack;

the loop comprising an upper wall abutting the inverted J-shaped section and a spaced lower wall defining therebetween an open sided channel facing away from the central axis, the short leg of the J-shaped section extending across the open sided channel throughout the periphery of the open end of the sack;

an elastic restraining loop received in the open sided channel and in engagement with the short leg throughout the periphery of the open end of the sack for captivating the open edge portion of the sack in the channnel; and a handle secured to the loop and extending away from the central axis at a first location spaced from the open sided channel to a second location spaced from the first location.

2. The bag holder of claim 1 wherein the open channel is of generally U-shaped cross-section, the legs of the U extending away from the central axis and being substantially parallel.

3. The bag holder of claim 1 wherein the first location lies on the lower wall of the loop and the second location is generally coplanar with the lower wall of the loop.

4. The bag holder of claim 3 wherein the lower wall is generally planar and the handle comprises a generally planar C-shaped structure in the plane of the lower wall.

5. The bag holder of claim 4 wherein the handle comprises a pair of generally parallel legs connected to the lower wall and a central leg connected to the parallel legs, the central leg comprising an inner edge, an outer edge and a central section spanning the inner and outer edges, the inner and outer edges being thicker than the central section.

6. The bag holder of claim 1 further comprising means connecting the elastic restraining loop to the handle.

7. The bag holder of claim 1 wherein the loop is generally oblong.

8. The bag holder of claim 1 wherein the upper wall, the lower wall and the first location define a line parallel to the central axis, the first location lying on the lower wall.

9. The bag holder of claim 1 wherein the upper wall, the lower wall and the first location define a line and the lower wall is between the upper wall and the first location.

10. The bag holder of claim 8 wherein the lower wall is generally planar and the handle includes a first section extending out of the plane of the lower wall away from the upper wall, a second section extending diagonally toward the central axis and a third section extending radially away from the second section.

11. The bag holder of claim 10 wherein the first and third sections comprise generally S-shaped curves and the third section terminates in an end, the end residing out of the plane of the lower wall at a location adjacent the central axis.

12. The bag holder of claim 1 wherein the first location is axially spaced from the open sided channel and the second location is radially spaced from the first location.

* * * * *